US005943920A

United States Patent [19]

McGivern et al.

[11] Patent Number: 5,943,920

[45] Date of Patent: Aug. 31, 1999

[54] JAR AND BOTTLE LID CLOSING AND OPENING DEVICE

[76] Inventors: Barbara Jane McGivern, 18 Tresillian Road, Toronto, Ontario, Canada, M3H 1L6; Raymond A. DelCastilho, 48 Barbour Crescent, Ajax, Ontario, Canada, L1S 6Z6

[21] Appl. No.: 09/032,878

[22] Filed: Mar. 2, 1998

[51] Int. Cl.[6] ..... B25B 7/16

[52] U.S. Cl. ..... 81/3.55; 81/3.25; 81/3.44

[58] Field of Search ..... 81/3.25, 3.4, 3.44, 81/3.55

[56] References Cited

U.S. PATENT DOCUMENTS 2,671,362 3/1954 Wilson ..... 81/3.25

*Primary Examiner*—David A. Scherbel

*Assistant Examiner*—Sinclair Skinner

*Attorney, Agent, or Firm*—David W. Wong

[57] ABSTRACT

The device has a V-shaped wedge provided with a flexible belt which is adjustable to locate on either side of the inside surfaces of the wedge. The belt has frictional side surfaces. The lid of a jar may be either opened or closed by jamming against the convergent inside surfaces between one side of the wedge and the belt adjusted to abut the other side of the wedge. One end of the belt is mounted to the vertex of the wedge and its other end is mounted to a slider button sliderably mounted to an arcuate periphery of a supporting plate of the device.

19 Claims, 3 Drawing Sheets

JAR AND BOTTLE LID CLOSING AND OPENING DEVICE

BACKGROUND OF THE INVENTION

Lids mounted by threading onto jars or bottles are difficult to tighten or loosen by hand. Numerous devices have been developed for alleviating the difficulty in such task. Some of such devices are hand-held and others are fixedly mounted under the cupboard or a shelf. The hand-held devices commonly have an adjustable gripping means which is operative for grasping the lid of the jar firmly, and a handle which the user may then turn relative to the jar so as to loosen or tighten the lid. Such hand-held devices are usually awkward to operate since the user must hold the jar or bottle firmly with one hand while turning the handle of the device with the other hand. Such operation is often rather frustrating due to that the jar or bottle can not be held firmly with one hand which invariably is the hand with the weaker grip, or the user simply does not have the dexterity or strength to carry out the operation. The mounted openers are more convenient and easier to operate since the user may grip the jar or bottle firmly with both hands and turning it relative to the mounted opener. However, most of such devices are designed only for opening the jar or bottle lid and they can not be used for tightening the same. Tightening of jar or bottle lid is particularly essential such as in the canning operation in which the lid must be secured firmly to an air-tight state in order to assure the preservation of the food for a long period of time without spoilage.

In U.S. Design Pat. No. 258,192 to Robert W. Maloney, it shows a jar opener of a V-shaped wedge mounted under the kitchen cupboard. Two serrated blades are mounted one on each side of the wedge with the teeth on one blade skewed in one direction and the teeth of the other blade skewed in the opposite direction. When the lid of the jar is urged against the blades, the teeth of the two blades, skewed in the opposite directions, would cooperate to grip the lid firmly by biting into the lid side wall while the jar is being turned so as to open the lid. Such device is effective for opening the lid but it can not operate to tighten the latter. Furthermore, the side surface of the lid would be inherently marred by the teeth of the blades biting into the lid side wall and creating rather sharp burr therein. Such sharp burr can cause harmful cuts or scratches in the user's hand if the lid is gripped or touched unsuspectingly thereafter.

U.S. Pat. No. 4,262,560 by Charles C. Hoffberger shows an opener which may be used for opening as well as for securing the lid of a bottle or jar. The device is in the form of a wedge having a rubber lining mounted on the inside surface of both sides of the wedge. A rigid bar is mounted at the center of the wedge to divide the wedge into two halves. The lid of the jar may be opened or closed by chocking the lid against a selected half of the wedge. The main drawback of the Hoffberger device is that the centre dividing bar is mounted to the supporting top plate by adhesive. Since the dividing bar is subjected to a very high sideways shearing force when the lid of the jar is forced against the wedge and turned in the operation, the dividing bar would dislodge from the mounting either readily or after a short period of use. Even if the bar were mechanically mounted solely or in addition to the adhesive, it would invariably still be distorted under the extremely high sideways pushing or side shearing force, thus rendering the device inoperative. Furthermore, the device is relatively and awkwardly large in size due to the requirement essentially of having to provide two wedges, one for opening and the other for closing the jar lid. Still furthermore, since the rubber liners are fixedly mounted on the inside surface of the wedge, they are difficult to repair and/or replace.

SUMMARY OF THE INVENTION

It is a principal object of the present invention to provide a device which is operative effectively for both opening and/or tightening the lid of a jar or bottle.

It is another object of the present invention to provide a device which imposes no damage to the lid in its operation.

It is another object of the present invention to provide a device which is operative with one hand for opening or tightening the lid of a jar or bottle.

It is another object of the present invention to provide a device which is simple to operate and the component parts may be assembled and replaced easily and quickly.

It is still another object of the present invention to provide a device which is simple in construction and yet operates effectively.

DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
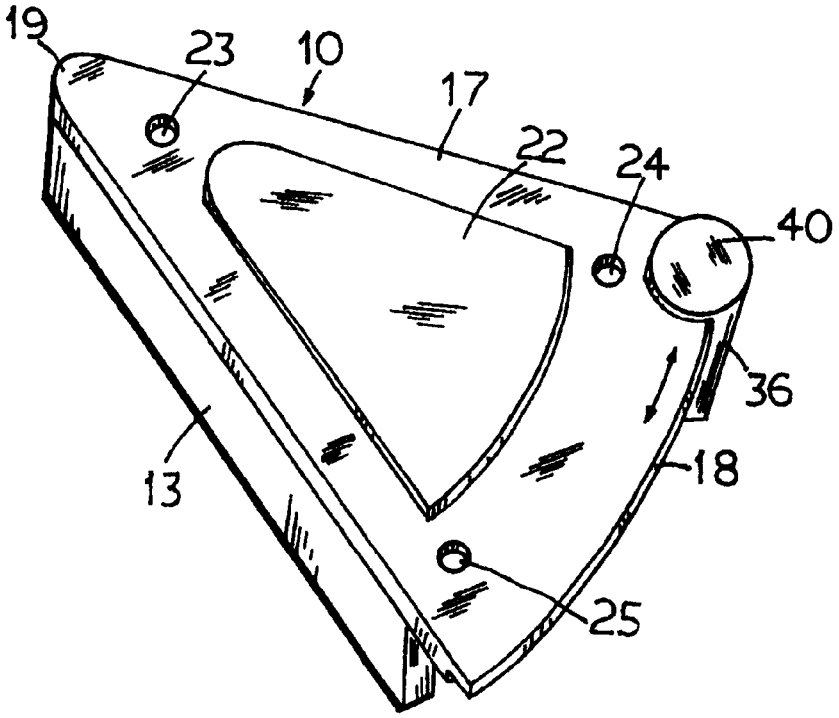
FIG. 1 is a top perspective elevation view of the device according to the present invention.
Figure 2:
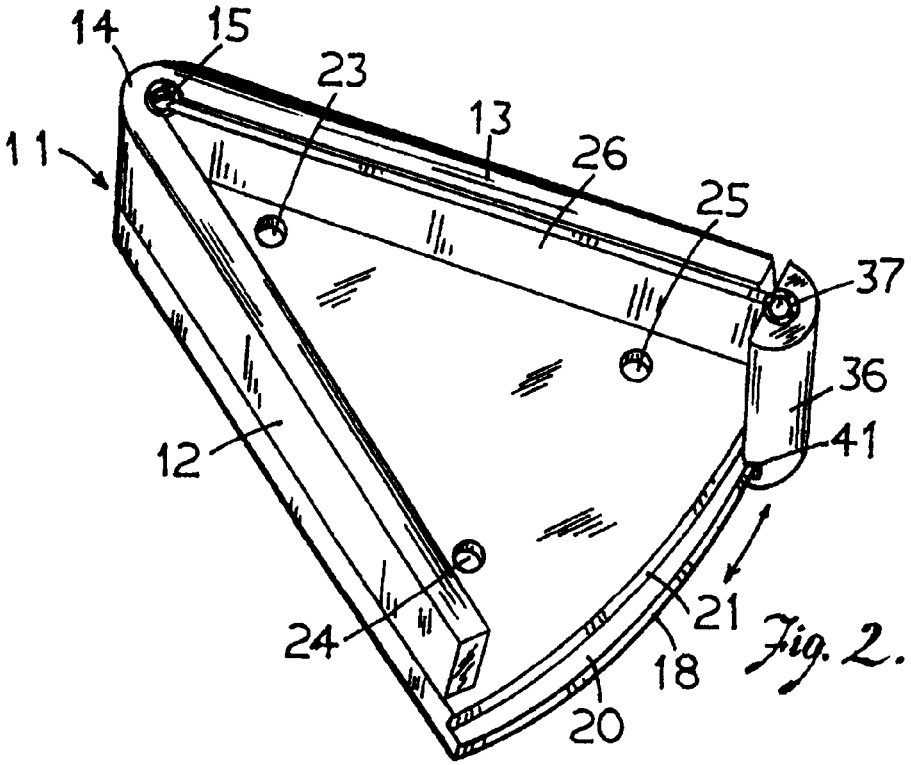
FIG. 2 is a bottom perspective elevation view thereof.
Figure 3:
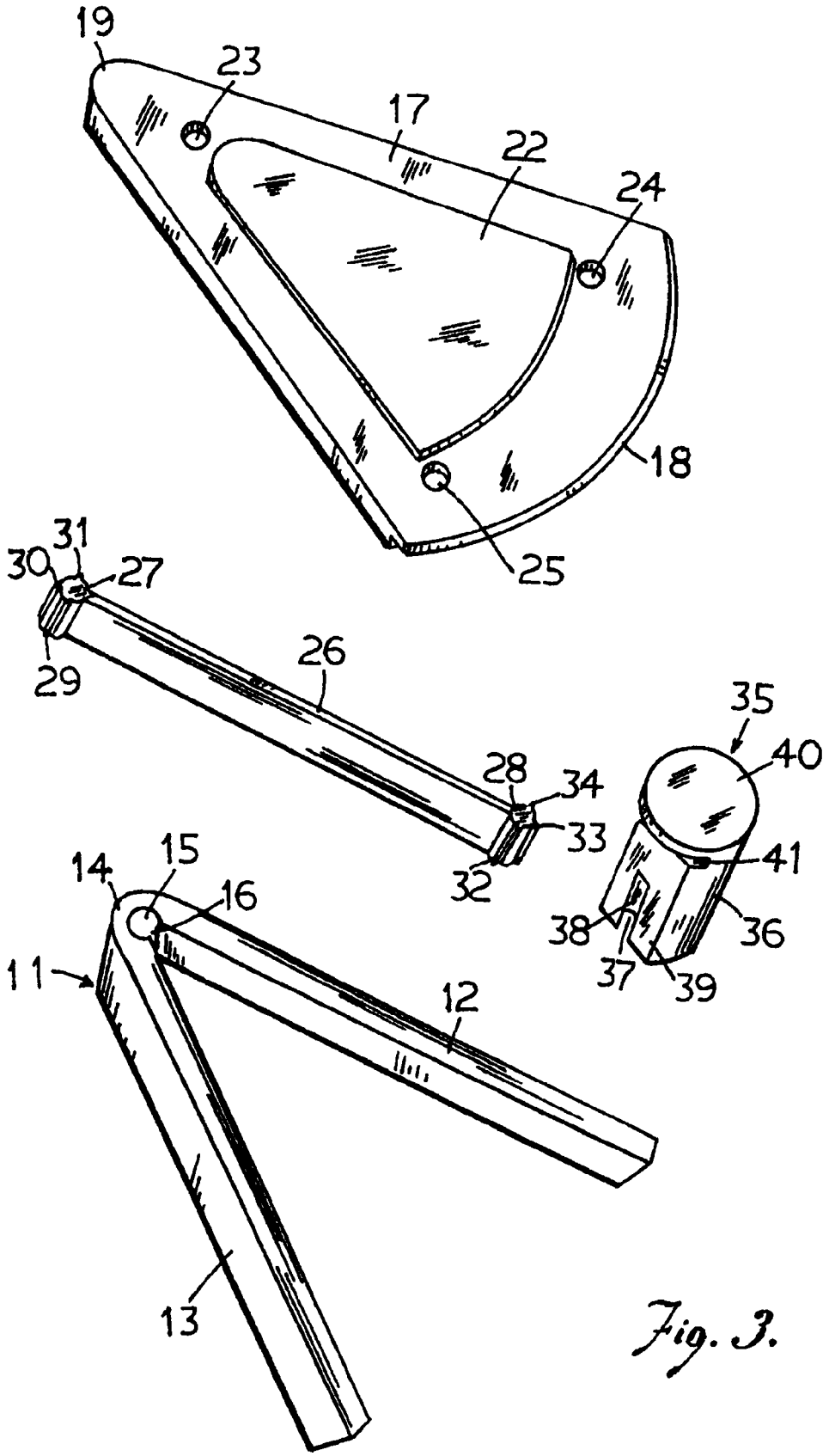
FIG. 3 is a top exploded perspective elevation view showing the component parts thereof.

With reference to the drawings wherein like reference numerals designate corresponding parts in the various views, the opening and closing device 10 according to the present invention has a V-shaped main body 11 having two elongated legs 12 and 13 extending divergently from a vertex 14 to form a wedge. The elongated legs 12 and 13 have a substantially flat inside surface, and these flat inside surfaces face each other in the wedge. The main body 11 may be formed with a rigid material such as plastic or metal. A through opening 15 is formed at the vertex 14 of the main body 11. The through opening 15 is open through a vertical slot 16, as best shown in FIG. 3, to the inside of the wedge. The main body 11 has a support plate 17 which has a generally triangular shape similar to that of the wedge of the main body 11 and has an arcuate peripheral edge 18 located distal to the angular end 19 therein. The main body 11 and the support plate 17 may either be formed integrally in a single fabrication process or be formed separately and then mounted together. The length of the support plate 17 from the angular end 19 to the arcuate peripheral edge 18 is slightly longer than each leg 12 or 13 of the main body 11.

A recessed step 20 is preferably formed along the underside of the arcuate peripheral edge 18 such that a recessed arcuate peripheral edge 21 similar in curvature to the arcuate peripheral edge 18 is provided a short distance from the arcuate peripheral edge 18. The reason for providing a step 20 will become apparent from the following description.

A two-sided high strength adhesive mounting pad 22 is provided on top of the support plate 19 such that the device 10 may be conveniently and quickly mounted, without the use of any tool, under the cupboard, a shelf or a counter commonly located in the kitchen. Mounting openings 23, 24 and 25 may also be provided in the support plate such that the device may alternatively be mounted by screws.

A flexible belt 26 is mounted in the wedge of the main body 11, and it is made of an elastic material such as rubber or flexible polyvinylchloride commonly known as PVC, having an elastic characteristic as well as having side surfaces with a high coefficient of friction. A generally cylindrical mounting plug 27 and a similar second mounting plug 28 may be integrally formed at the two ends of the belt 27 as best shown in FIG. 3. The mounting plugs 27 and 28 each has a diameter and height similar to those of the mounting opening 15 in the main body 11, so that the belt 26 may be mounted within the wedge with the plug 27 engaging snugly within the mounting opening 15 and the belt 26 extending within the wedge through the vertical slot 16. Vertical ridges 29, 30 and 31 may be formed on the side surface of the plug 27 to ensure the snug fitting of the plug 27 within the mounting opening 15. Similarly, vertical ridges 32, 33 and 34 are formed on the side surface of the mounting plug 28. An adjusting button 35 is securely mounted to the mounting plug 28 at the free end of the belt 26. The adjusting button 35 has a semi-cylindrical lower portion 36 having a vertical mounting opening 37 formed at its underside. The vertical mounting opening 37 is accessible through an open side slot 38 formed in a vertical flat surface 39 therein. The vertical mounting opening 37 has the same dimensions as the mounting opening 15 formed at the vertex 14 of the main body 11. The adjusting button 35 is mounted to the belt 27 by engaging the plug 29 with the vertical mounting opening 37 through the side slot 38 similar to the way the plug 27 is secured to the mounting opening 15 at the vertex of the wedge. Since both the mounting plugs 27 and 28 are identical to each other, the belt 26 may be mounted with either the mounting plug 27 or the mounting plug 28 engaging with the mounting opening 15 at the vertex of the wedge and the other plug mounted to the adjusting button 35 and vice versa. Alternatively, the belt 26 may have only one mounting plug 27 formed at one end for mounting to the mounting opening 15 at the vertex of the wedge, and the other end of the belt 26 is simply a flat free end secured to the adjusting button 35 either by adhesive and/or other mechanical means. An enlarged retaining plate 40 which may be circular in shape as shown in the drawings, is provided at the top portion of the adjusting button 35 and a transverse horizontal slot 41 is formed between the semi-cylindrical lower portion 36 and the retaining plate 40. The length of the belt 26 together with the depth of the horizontal slot 41 is shorter than the length of the support plate 17 from the vertex 19 the arcuate peripheral edge 18 such that the belt 26 needs to be stretched initially to engage the horizontal slot 41 of the adjusting button 35 with the arcuate peripheral edge 18 of the support plate 17 in order to mount the adjusting button 35 slidably onto the arcuate peripheral edge 18 of the support plate 17. With the elastic force of the belt 26 pulling the adjusting button 35 against the arcuate peripheral edge 18 of the support plate 17, the adjusting button 35 may be moved sideways slidably to locate in any selected position over the arcuate peripheral edge 18 so as to locate the belt 26 at a corresponding selected position within the wedge from one side to the other. In this manner, the belt 26 may be selected to abut either side of the wedge. Furthermore, the flat surface 39 of the adjusting button 35 extends inwards to abut the recessed arcuate peripheral edge 21 to retain the adjusting button 35 in the stable mounted position.

Figure 6:
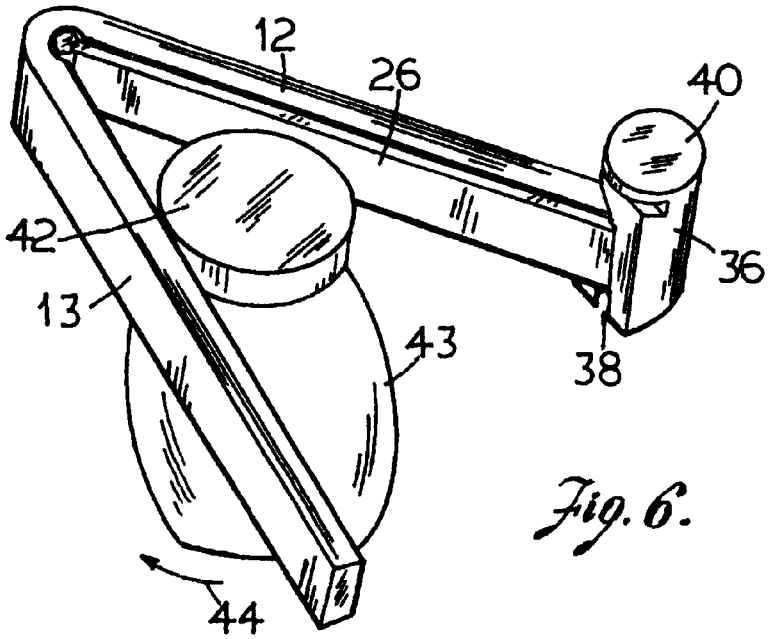
FIG. 6 is a perspective top elevation view with the top supporting plate removed to show the operation of the device.

As best shown in FIG. 6, with the support plate 17 removed, in order to open a lid 42 of a jar 43, the adjusting button 35 is moved to the right until the belt 26 abuts the right inside surface of the right leg 13 of the wedge; and the lid 42 of the jar is then urged against the wedge while the jar is being turned clockwise. During this operation, the lid 42 would tend to slide over the inside surface of the left leg 12 towards the vertex of the wedge while it is restrained from sliding away from the vertex by engaging with the frictional surface of the flexible belt 26 located over the right side. It would be gripped ever so tighter by the wedge while the jar 43 is being turned clockwise as indicated by the arrow 44 until the lid 42 is opened by the counterclockwise reaction force. The jar 43 may be turned with easy with either one hand or both hands in such operation.

When it is desired to tighten the lid, the adjusting button 35 is moved sideways to locate the belt 26 in abutment with the inside surface of the left leg 12 of the wedge; and the lid is placed within the wedge between the belt 26 and the right leg 13; and the jar is turned counterclockwise with either with one hand or both hands while the lid is urged towards the vertex of the wedge. The lid would thus be tightened by the clockwise reaction force.

The relatively large retaining plate 40 ensures the adjusting button 35 would not accidentally disengage from the peripheral arcuate edge 18 of the support plate 17; and the flat surface 39 of the semi-cylindrical lower portion 36 of the adjusting button 35 also extends over the step 20 to abut the recessed arcuate peripheral edge 21 so as to ascertain the adjusting button 35 is mounted securely in a position substantially perpendicular to the support plate 17.

Figure 4:
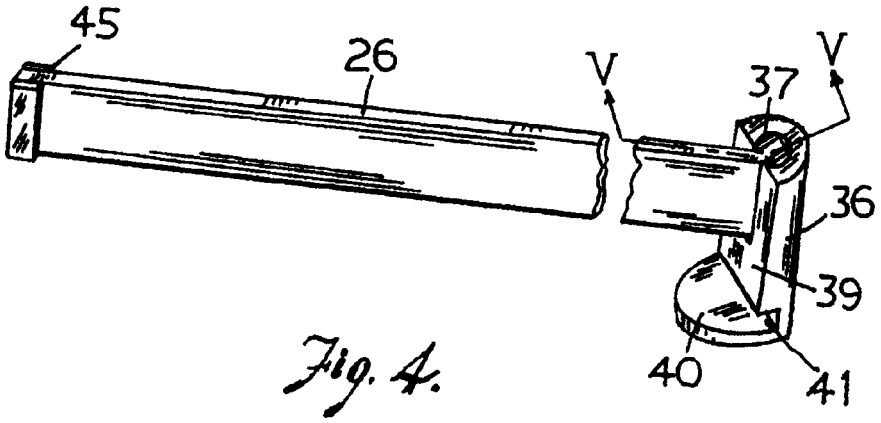
FIG. 4 is an enlarged side perspective view of the adjustable frictional belt with an alternative mounting end construction.
Figure 5:
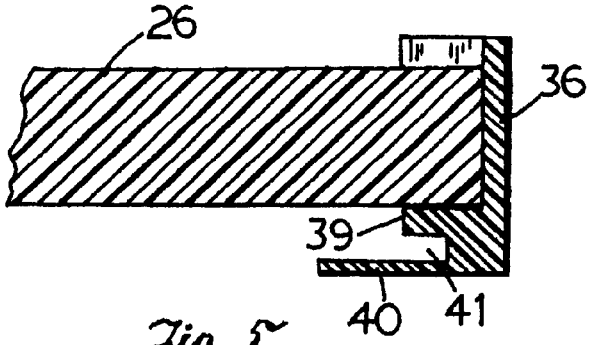
FIG. 5 is a partial side cross section view along cross section line V—V in FIG. 4 showing the general construction of the retaining and adjusting button for the frictional belt.

Due to the simplicity of the mounting of the flexible belt 26 to the wedge and the adjusting button, it may be easily assembled or replaced. Also, instead of the cylindrical plugs 27 and 28, a rectangular plug 45 as best shown in FIG. 4 may alternatively be integrally formed at the each mounting end of the flexible belt 26 for mounting the latter to the mounting opening 15 at the vertex 14 of the wedge as well as the vertical mounting opening 37 in the adjusting button 35; or still alternatively, a clip may be mechanically fastened to the each mounting end of the belt 26 to serve the same purposes.

Various modifications can be made without departing from the spirit of this invention or the scope of the appended claims. The embodiments set forth in this disclosure are given as examples and are in no way final or binding. In view of the above, it will be seen that several objects of the invention are achieved and other advantages are obtained. As many changes could be made in the above construction and methods without departing from the scope of the invention, it is intended that all matter contained in the above description shall be interpreted as illustrative and not in a limiting sense.

What we claim is:

1. A device operative for selectively opening and tightening a lid of a jar, bottle and the like, comprising a V-shaped main body having two elongated leg portions extending divergently from a vertex to form a wedge, said leg portions having inner surfaces facing one another, a generally triangular shaped support plate covered over said wedge, said support plate having an arcuate peripheral edge located distal from said vertex, a flexible belt member having one end mounted at said vertex and a Free end extending within said wedge and outwards from said vertex, said belt member having said surfaces with a high coefficient of friction, an adjustable button member mounted at said free end of said belt member, and said button member having a transverse slot formed therein operative to engage slidlably with said arcuate peripheral edge of said plate whereby said adjustable button member is movable slidably over said arcuate peripheral edge to locate said flexible belt member selectively to abut a selected inner surface of one of said leg portions.

2. A device according to claim 1 including a transverse opening formed at said vertex of said wedge, said transverse opening being opened to said wedge through a vertical side slot opening formed therein, a mounting plug member formed at said one end of said flexible belt member, said plug member being adapted to engage within said transverse opening at said vertex for mounting said belt member to said main body.

3. A device according to claim 2 including a second mounting plug member formed at said free end of said flexible belt member, and a vertical mounting opening formed in said adjusting button member, said second mounting plug member being adapted to engage with said vertical mounting opening for securing said free end of said flexible belt member to said adjusting button member.

4. A device according to claim 3 wherein said support plate has a length longer than said flexible belt member.

5. A device according to claim 4 including an adhesive pad disposed on a top surface of said support plate.

6. A device according to claim 4 including a plurality of through openings formed in said support plate.

7. A device for selectively opening and tightening the lid of a jar, bottle and the like, comprising a V-shaped main body having a vertex and two elongated leg portions extending outwardly and divergently from said vertex to form a wedge, and said leg portions having substantially flat inner side surfaces facing one another, a mounting opening formed at said vertex and said mounting opening having a side slot open to said wedge, said wedge having a substantially triangular shaped support plate disposed over said main body, said support plate having a shape similar to said wedge and having a length longer than said leg portions and including an arcuate peripheral edge located distal from said vertex, a flexible belt disposed in said wedge and having two side surfaces with a high coefficient of friction, said belt having one end secured to said vertex and a free end juxtaposed to said arcuate peripheral edge of said support plate, an adjustable button member mounted to said free end of said flexible belt and being slidably mounted on said arcuate peripheral edge of said support plate whereby said button member is movable slidably on said arcuate peripheral edge of said support plate to locate said flexible belt to abut a selective inside surface of said leg portions.

8. A device according to claim 7 including a recessed arcuate peripheral edge formed in a step manner adjacent to said arcuate peripheral edge.

9. A device according to claim 8 including a high strength adhesive pad disposed on said support plate.

10. A device according to claim 8 including a plurality of through openings formed in said support plate and adapted for mounting said device by screws to a horizontal support surface.

11. A device according to claim 9 including a mounting opening formed at said vertex and said mounting opening having an open side slot open to said wedge, and said flexible belt having a mounting plug member provided at said one end, said mounting member being operative to engage with said mounting opening at said vertex for mounting said flexible belt to said main body.

12. A device according to claim 11 including a second mounting plug member formed at a second end of said flexible belt, and a vertical mounting opening formed in said adjusting button member, said second plug member being adapted to engage with said vertical mounting opening for securing said adjusting button member to said flexible belt.

13. A device according to claim 12 wherein said mounting plug member and second mounting plug member are substantially cylindrical plugs integrally formed at said one end and said second end of said flexible belt.

14. A device according to claim 13 wherein said mounting plug member and said second mounting plug member are similar in shape and size whereby said flexible belt is reversible and is selectively mounted with a selected end mounted to said wedge and said adjusting button member and vice versa.

15. A device according to claim 14 wherein said mounting plug member is a clip member secured to said one end.

16. A device according to claim 14 wherein said adjustable button member includes a semi-cylindrical lower portion having a flat side surface juxtaposed to said arcuate peripheral edge of said support plate, a top plate disposed slidably over said support plate, and a recess slot disposed between said semi-cylindrical lower portion and said circular top plate, said recess slot being adapted to engage slidably with said arcuate peripheral edge of said support plate.

17. A device according to claim 16 wherein said top plate is a circular disc integrally formed on said adjustable button.

18. A device according to claim 17 wherein said flexible belt is a flat elongated belt made of a rubber compound.

19. A device according to claim 17 wherein said flexible belt is a flat elongated belt made of polyvinylchoride.

* * * * *